US005919123A

United States Patent [19]

Phillips

[11] Patent Number: 5,919,123

[45] Date of Patent: Jul. 6, 1999

[54] METHOD FOR CONTROLLING A CENTRIFUGE SYSTEM UTILIZING STORED ELECTRICAL ENERGY GENERATED BY BRAKING THE CENTRIFUGE BOWL

[75] Inventor: Victor Phillips, Luther, Okla.

[73] Assignee: M-I Drilling Fluids L.L.C., Houston, Tex.

[21] Appl. No.: 08/920,956

[22] Filed: Aug. 29, 1997

Related U.S. Application Data

[60] Provisional application No. 60/036,523, Jan. 29, 1997.

[51] Int. Cl.[6] ..... B04B 9/10; B04B 13/00

[52] U.S. Cl. ..... 494/7; 494/37; 494/84

[58] Field of Search ..... 494/1, 11, 7–10, 494/37, 42, 52–54, 82–84; 210/143, 145, 781, 784

[56] References Cited

U.S. PATENT DOCUMENTS 4,299,353 11/1981 Bruning et al. .
4,303,192 12/1981 Katsume .
4,334,647 6/1982 Taylor .
4,369,915 1/1983 Oberg et al. .
4,421,502 12/1983 Jakobs ..... 494/7
4,432,747 2/1984 Posse et al. .
4,668,213 5/1987 Kramer .
4,720,776 1/1988 Guyeska et al. .
5,203,762 4/1993 Cooperstein .
5,403,260 4/1995 Hensley .
5,681,256 10/1997 Nagafuji ..... 494/9
5,714,858 2/1998 Pieralisi ..... 494/84
5,857,955 1/1999 Phillips et al. ..... 494/84

*Primary Examiner*—Charles E. Cooley
*Attorney, Agent, or Firm*—Haynes & Boone, LLP

[57] ABSTRACT

A centrifuge system and method according to which a conveyor is disposed in the bowl, and electrical motors are provided for rotating the bowl and the conveyor at different speeds. A DC bus is provided to store electrical energy which is supplied to the conveyor motor to rotate the conveyor if a brownout condition occurs. The bowl is braked in response to the brownout condition to generate electrical energy which is transferred to, and stored by, the DC bus for supplying to the conveyor motor.

6 Claims, 1 Drawing Sheet

METHOD FOR CONTROLLING A CENTRIFUGE SYSTEM UTILIZING STORED ELECTRICAL ENERGY GENERATED BY BRAKING THE CENTRIFUGE BOWL

CROSS REFERENCE

This application claims the benefit of U.S. Provisional Application Ser. No. 60/036,523 filed Jan. 29, 1997.

BACKGROUND OF THE INVENTION

The present invention relates to a centrifuge system and a method for controlling same, and, more particularly, to such a system and method in which the operation of the centrifuge system is sustained during power outages or shortages.

Decanting centrifuge centrifugal separator, or "centrifuges", are well known in the art and are designed to process a mixture of two constituents, usually a liquid and a solid, separating one from the other. These types of centrifuges feature a rotating bowl and a spiral screw conveyer disposed inside the bowl which rotates in the same direction as the bowl and at a different, usually less, speed. The mixture, which for the purpose of example, will be assumed to be a liquid having relatively fine solid particles entrained therein, enters the bowl and the centrifugal forces direct and hold it against the inner wall of the bowl in a "pool" while the fluid is displaced to one end portion of the bowl for discharge. The solid particles settle against the wall and are transported, or displaced, by the screw conveyor to discharge ports extending through the opposite end portion of the bowl for discharge. Typical applications of this type of centrifuge is in pulp, paper, and waste water treatments and for the removal of dirt, sand, shale, abrasive cuttings, and/or silt particles (hereinafter referred to as "solid particles") from drilling fluid after the fluid has been circulated through a drilling bit to lift the cuttings to the surface in an oil field drilling operation.

There are several parameters involved in the operation of a centrifuge, such as bowl speed and torque, conveyor speed and torque, fluid pump rate, fluid viscosity or dilution, and fluid solids content and properties. Since the operational goals of the centrifuge itself are fairly precise, it is important that the centrifuge be controlled so that its operation is optimized in response to variations in the above parameters. Also, the centrifuge itself can be operated in different modes in accordance with different design goals, such as maximum solids separation, maximum solids discard volume, etc., which requires further precise control. U.S. Pat. No. 5,857,955, assigned to the assignee of the present invention, discloses a control system which maintains precise predetermined operational modes despite variations in the various operational parameters and design goals and which includes computer programs stored on computer-readable media that can be utilized to achieve these goals.

The system disclosed in the above-identified application, as well as other systems known in the art, often use a variable frequency drive to drive the centrifuge bowl. In some of these designs, another variable frequency drive is used to drive the conveyor at a difference speed than the bowl. Variable frequency drives require constant electrical power which is properly regulated and free from power interruptions and periods of low voltage or deviations in frequency. However, when these drives are used major problems can occur when a power outage or reduction occurs (referred to as a "brownout" condition), e.g. when the voltage from the power source for the centrifuge, which is usually a generator, is reduced or terminated for a short period of time due to a malfunction of the generator, or when additional load is imposed on the generator. For example, when a brownout condition occurs even for a short period of time, the centrifuge bowl will continue rotating, albeit at a relatively lower speed, for some time thereafter due to its momentum. However, during this time the rotation of the conveyor is not being controlled. Therefore, if the bowl and the conveyor come to the same speed, the solids remaining in the bowl will not be conveyed out by the conveyor but, rather, will "pack off," or lock, the bowl to the conveyor. Even if the power is restored in a very short time, the torque, and resulting current draw, required to again create the differential speed between the bowl and the conveyor often cannot be obtained. As a result, the collected solids in the centrifuge bowl prevent subsequent separation operations and the bowl and conveyor must be cleaned either by shutting down the centrifuge and doing it manually or by an automatic clean-out cycle. These cleaning operations can be time consuming especially if done manually.

Although several options are available to accommodate brownout conditions and either sustain the separation operations or, at least, continue to expel the collected solids from the conveyor, they are less than satisfactory. For example, attempts have been made to alter the input limits to the variable frequency drive for the centrifuge bowl and/or the conveyor. However, this can result in damage to the drive. Also, large capacitor banks, or separate "stand-by" generators have been provided to come on line and provide electrical power when power loss is detected. However the capacitor banks are hazardous and the stand-by generators are both expensive and unreliable. Therefore, what is needed is a system and method according to which electrical power to a variable frequency drive is supplied during brownout conditions that is not hazardous yet relatively inexpensive and reliable.

SUMMARY OF THE INVENTION

To this end, according to the system and method of the present invention, a DC bus is provided to store electrical energy which is supplied to the conveyor motor to rotate the conveyor. The bowl is braked in response to a brownout condition to generate electrical energy which is transferred to, and stored by, the DC bus for supplying to the conveyor motor to maintain its rotation and maintain a speed differential between it and the rotating bowl.

As a result, major advantages are achieved with the system and method of the present invention since the system generates electrical power and utilizes it on demand, and therefore is relatively inexpensive, yet is reliable and not hazardous.

DESCRIPTION OF THE PREFERRED EMBODIMENT

Figure 1:
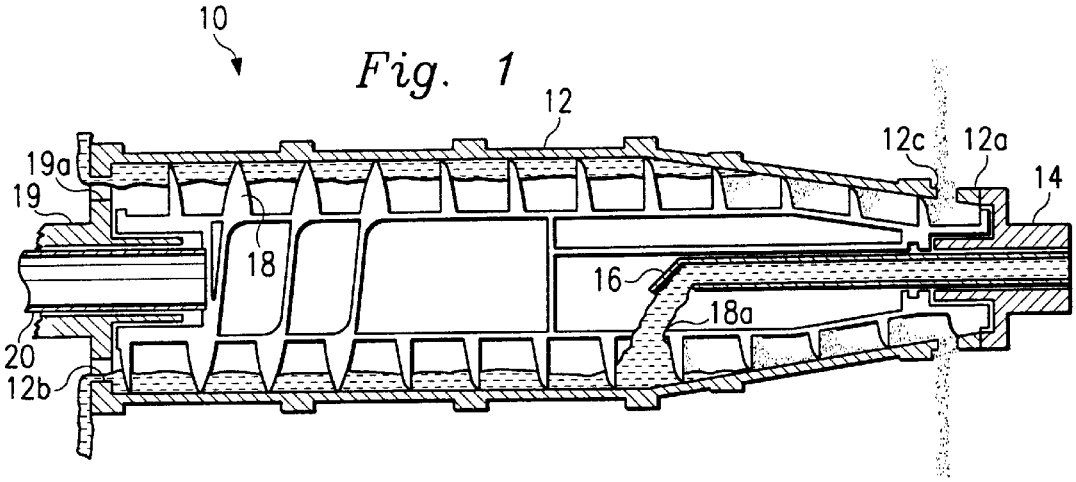
FIG. 1 is a sectional view of a centrifuge which is operated by the control system of the present invention.

Referring to FIG. 1 of the drawings, the reference numeral 10 refers, in general, to a centrifuge the operation of which is controlled by the system, and according to the method and the computer program of the present invention. The centrifuge 10 includes an elongated bowl 12 supported for rotation about its longitudinal axis. The bowl 12 has two open ends 12*a* and 12*b*, with the open end 12*a* receiving a drive flange 14 which is connected to a drive shaft (not shown in FIG. 1) for rotating the bowl. A longitudinal passage extends through the drive flange 14 for receiving a feed tube 16 for introducing a feed slurry which, for the purposes of example, is a mixture of fluid and disbursed solid particles, into the interior of the bowl 12.

A screw conveyor 18 extends within the bowl 12 in a coaxial relationship thereto and is supported for rotation within the bowl by a plurality of bearings (not shown) disposed at the ends of the bowl. To this end, a hollow flanged shaft 19 is disposed in the end 12*b* of the bowl, extends to an external planetary gear box (not shown in FIG. 1) and receives a drive shaft 20 of the latter gear box. The drive shaft 20 transmits torque from the gearbox to rotate the screw conveyor 18 in the same direction as the bowl but at a different speed. One or more openings 18*a* extend through the wall of the conveyor 18 near the outlet end of the tube 16 so that the centrifugal forces generated by the rotating bowl 12 causes the slurry to gravitate radially outwardly and pass through the openings 18*a* and into the annular space between the conveyor and the bowl 12. The liquid portion of the slurry is displaced to the end 12*b* of the bowl 12 while the entrained solid particles in the slurry settle towards the inner surface of the bowl due to the G forces generated, and are scraped and displaced by the screw conveyor 18 back towards the end 12*a* of the bowl for discharge through a plurality of discharge ports 12*c* formed through the wall of the bowl 12 near its end 12*a*. A plurality of weirs 19*a* (two of which are shown) are provided through the flanged portion of the shaft 19 for discharging the separated liquid. This type of centrifuge is known in the art and, although not shown in the drawings, it is understood that the centrifuge 10 would be enclosed in a housing or casing, also in a conventional manner.

Figure 2:
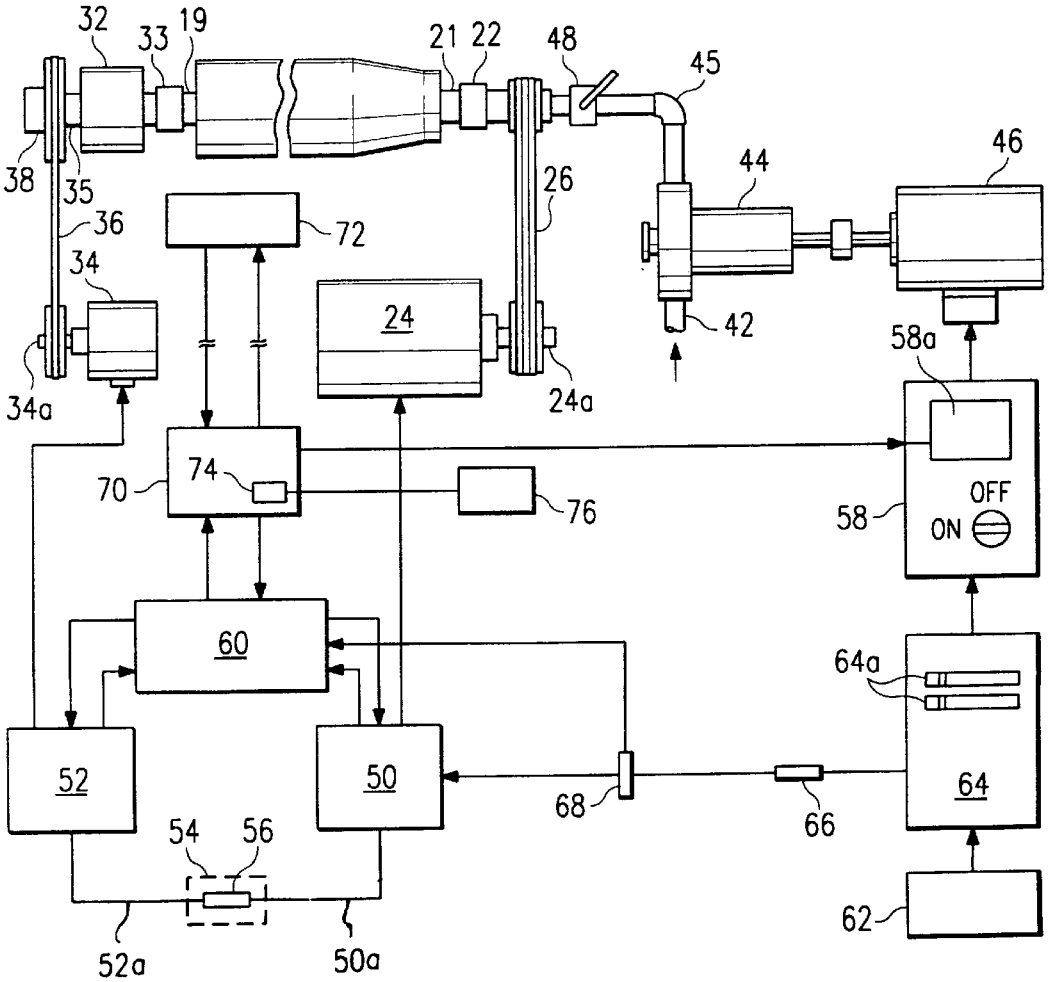
FIG. 2 is a schematic view depicting the centrifuge of FIG. 1 along with its associated components and the control system of the present invention.

Referring to FIG. 2, a drive shaft 21 forms an extension of, or is connected to, the drive flange 14 (FIG. 1) and is supported by a bearing 22. A variable speed AC main drive motor 24 has an output shaft 24*a* which is connected to the drive shaft 21 by a drive belt 26 and therefore rotates the bowl 12 (FIG. 1) of the centrifuge 10 at a predetermined operational speed. The flanged shaft 19 extends from the interior of the conveyor 18 to a planetary gear box 32 and is supported by a bearing 33. A variable speed AC back drive motor 34 has an output shaft 34*a* which is connected to a sun wheel 35 by a drive belt 36 and the sun wheel is connected to the input of the gear box 32. Therefore the motor 34 rotates the screw conveyor 18 (FIG. 1) of the centrifuge 10 through the planetary gear box 32 which functions to establish a differential speed of the conveyor 18 with respect to the bowl 12. A torque limiting clutch 38 is provided on the shaft of the sun wheel 35, and functions in a conventional manner to control the torque applied to the gearbox 32 so that the shaft 20 (FIG. 1) of the gearbox 32 drives the conveyor 18 at a speed slightly slower than that of the rotating bowl 12.

A conduit 42 is provided for receiving and containing the feed slurry being processed, and a pump 44 has an inlet connected to an end of the conduit 42 and an outlet connected to the end of a conduit 45. The conduit 45 extends into and through the drive shaft 21 and is connected to the feed tube 16 (FIG. 1). A drive unit 46, preferably in the form of an electric motor, is connected to the pump 44 for pumping the slurry from the conduit 42, through the conduit 45 and the feed tube 16 into the centrifuge 10. A valve 48 is connected in the feed tube 45 for controlling the flow of the slurry into the bowl 12.

Two variable speed drive units 50 and 52 are respectively connected to the motors 24 and 34 for driving same at variable frequencies and at variable voltages as dictated by the operational requirements of the system as will be described. The drive units 50 and 52 have DC bus connections 50*a* and 50*b*, respectively, that extend to a DC bus 54. The drive unit 50 is adapted to operate on alternating current and has a converter for converting alternating current to direct current in a conventional manner, while the drive unit 52 is adapted to operate on direct current in a manner to be described.

The DC bus 54 is conventional, and, as such, includes a bank of capacitors (not shown) for receiving and storing electrical energy in a conventional manner. A fuse 56 is provided for the DC bus 54 to limit the amount of electrical energy transferred between the drives 50 and 52 for reasons that will be described.

A magnetic starter 58 is connected between the motor 46 and a breaker box 64 to receive power from the breaker box. The magnetic starter 58 has a magnetic contact 58*a* that receives a control signal in a manner to be described to control the operation of the pump 44.

A computer, preferably in the form of a small logic controller ("SLC") 60, is provided which contains computer programs stored on computer-readable media and containing instructions for controlling the operation of the centrifuge 10. The SLC 60 has several input terminals, two of which are respectively connected to the drive units 50 and 52 for receiving data from the drive units, and two output terminals for respectively sending control signals to the drive units. The SLC 60 thus responds to the input signals received and controls the drive units 50 and 52 in a manner so that the drive units can continuously vary the frequency and the voltage applied to the respective AC motors 24 and 34 accordingly, to continuously vary the rotation and the torque applied to the bowl 12 and the conveyor 18, in a manner to be described. Although not shown, the SLC 60 comprises conventional devices including, but not limited to, a processor, a main memory, a mass storage device, a video display, an input device, and an audible signal generating device. The operational details of the SLC 60 are not described since they are specifically disclosed in the above-identified patent application, the disclosure of which is incorporated by reference.

A source 62 of electrical power, such as a generator, is connected to a breaker box 64 which distributes the power to the drive unit 50 and to the motor 46 through the magnetic starter 58*a*. The breaker box 64 includes two breaker switches 64*a* which respectively limit the power applied to the drive unit 50 and the motor 46. A series of fuses, shown in general by the reference numeral 66, are connected in the line between the breaker box 64 and the drive unit 50 to limit the power transfer therebetween. An optional power sensor 68 can be connected in the line extending between the SLC and the line connecting the drive unit 50 to the breaker box, and functions to send voltage and frequency information to the SLC 60 to enable the SLC to predict power interruptions and brownouts.

A barrier box 70 has an input that is connected to an output of the SLC 60 and has two outputs that are respectively connected to inputs of the SLC and to the magnetic contact 58*a* of the starter 58. The barrier box 70 is connected to a console 72 for providing and receiving operational and control data to and from the console. It is understood that the barrier box 70 contains intrinsic safe barriers so that the console 72 can be located in the immediate vicinity of the centrifuge. In this manner, control and data signals from the console 72 will be safe from explosive gases found in oil field environments, or the like. A power supply 74 is provided in the barrier box 70 for generating a control signal (such as twenty four volts, for example) for the SLC 60 which is utilized in the operation of the centrifuge in a manner to be described. Other details of the barrier box 70 will not be described herein since they are well disclosed in applicant's co-pending U.S. patent application Ser. No. 08/689,843 filed on Aug. 14, 1996 and assigned to the assignee of the present invention, the disclosure of said application being incorporated by reference.

An uninterruptible power source 76 is provided that is connected to the power supply 74 to supply power to the power supply so that the above control signal is available to operate the system for a predetermined time after any power supplied to the breaker box 64 from the above-mentioned electrical generator has been interrupted.

In operation, the SLC 60 sends a control signal, via a relay, or the like, which, in turn, sends a pulse signal to the magnetic starter 58*a* which functions to start the electric motor 46 and thus activate the pump 44. The slurry, which, for the purpose of example, will be assumed to be a mixture of fluid and entrained solid particles, is pumped from the conduit 42 and into the interior of the bowl 12 in the manner described above.

The motor 24 is activated and controlled by the drive unit 50 to rotate the drive shaft 21, and therefore the bowl 12, at a predetermined speed. The motor 34 is also activated and driven by the drive unit 52 to rotate the sun wheel 35, and therefore the screw conveyor 18, through the planetary gear box 32, in the same direction as the bowl 12 and at a different speed.

As a result of the rotation of the bowl 12, the centrifugal forces thus produced forces the slurry radially outwardly so that it passes through the openings 18*a* in the conveyor and into the annular space between the conveyor and the bowl 12. The fluid portion of the slurry is displaced to the end 12*b* of the bowl 12 for discharge from the weirs 19*a* in the flanged shaft 19, while the entrained solid particles in the slurry settle towards the inner surface of the bowl due to the G forces generated, and are scraped and displaced by the screw conveyor 18 back towards the end 12*a* of the bowl for discharge through the discharge ports 12*c*.

The SLC 60 receives signals from the drive units 50 and 52 corresponding to torque and speed of the motors 24 and 34, respectively. The SLC 60 contains instructions which enables it to process the above data and control the drive units 50 and 52 based on a predetermined desired operational mode of the centrifuge 10. Thus, the drive units 50 and 52 will vary the frequency and voltage applied to the motors 24 and 34, respectively, as needed to continuously vary the rotational speed of, and the torque applied to, the drive shaft 21 and the sun wheel 35, respectively, as necessary to maintain predetermined optimum operating conditions.

In the event that a brownout occurs resulting in reduced power available from the power source 62 through the breaker box 64, the SLC 60 will detect same through its connection to the drive unit 50, and is programed to respond accordingly. More particularly, the SLC 60 will first turn the pump 46 off by reducing the magnitude of the control signal on the magnetic contact 58*a* of the starter 58. Then the SLC 60 will turn off all power supplied to the drive motor 24 through the drive unit 50 to allow the motor 24 to coast momentarily and thus not consume any additional power.

Under these conditions the torque applied to the conveyor 18 from the drive motor 34 and through the gear box 32 must be maintained to hold an acceptable differential rotational speed between the conveyor and the bowl 12 and to convey all of the separated solids out of the bowl. This is especially important due to the tendency of the conveyor 18 to lock to the bowl 12 in response to the coupling action caused by the solids extending therebetween. To this end, the stored energy in the capacitor bank associated with the DC bus 54 will be initially available to the drive motor 34 to continue to rotate the conveyor 18 to maintain this differential speed. However, the stored energy in the DC bus 54 will be depleted in a relatively short time. When this happens, the SLC 60 will modulate the drive motor 24 to dynamically brake, and thus decelerate the bowl 12. This creates a braking torque on the drive motor 24, and electrical energy, in the form of a variable frequency alternating current, is generated by the latter motor. This generated electrical energy is transferred to the drive unit 50 where it is converted to electrical energy having a direct current component before it is passed to the DC bus 54 via the bus connection 50*a*. The DC bus 54 stores and supplies the electrical energy to the drive unit 52 to drive the motor 34. The motor 34 will thus be able to continue to rotate the conveyor 18 with sufficient torque to maintain the required relative speed differential between the conveyor and the bowl 12 sufficient to convey all solids out of the bowl 12. When the stored electrical energy builds up, the SLC 60 will deactivate the motor 24 causing the bowl to coast and thus discontinue the regeneration of electrical energy as described; and when the stored energy is depleted, the SLC will activate the motor 24 causing a regeneration of electrical energy and a transfer of same to the motor 34 via the drive units 50 and 52 and the bus 54 as described above. This cycling will continue until the bowl comes to a complete stop.

If, however, the power from the source 62 is restored before the bowl looses regeneration ability, the SLC 60 will control the speed of the drive motors 24 and 34 so that they will attain their normal speed such that the fuse 56 will not be compromised until power from the source 62 is restored or until the system is shut down.

If, due to this power regeneration, there is danger of exceeding the amount of power that the DC bus 54 can handle, the SLC 60 will turn on the drive motor 24 through the drive unit 50 with an acceleration ramp to consume the generated power and maintain the power applied to the DC bus 54 within acceptable limits. During this sequence, the fuse 56 in the DC bus 54 prevents excessive current transfer between the drive units 50 and 52.

Therefore the SLC 60 controls the drive motors 24 and 34 in a manner to utilize the power regeneration capabilities of the system in order to keep the centrifuge 10 operating safely through a brownout, or during an emergency power loss situation. Also, the system and method of the present invention achieves these advantages without adding to the cost of the system. Further, the system and method of the present invention is relatively inexpensive, yet is reliable and not hazardous.

According to an alternate embodiment of the present invention, the drive motor 34, the drive unit 52, and the fuse 56 are eliminated and only the drive motor 24 is utilized. In this case, the SLC 60 is connected to the drive unit 50 and the drive unit 50 is connected to the drive motor 24 which is coupled to the bowl 12 and the conveyor 18 so as to drive same.

Thus, as in the previous embodiment, the SLC 60 will modulate the drive motor 24 to dynamically brake, and thus decelerate the bowl 12. This creates a braking torque on the drive motor 24, and electrical energy, in the form of a variable frequency alternating current, is generated by the latter motor. This generated electrical energy is transferred to the drive unit 50 where it is converted to electrical energy having a direct current component before it is passed to the DC bus 54 via the bus connection 50*a*. The DC bus 54 stores and supplies the electrical energy back to the drive unit 50 to drive the motor 34.

The motor 34 will thus be able to continue to rotate the conveyor 18 with sufficient torque to maintain the required relative speed differential between the conveyor and the bowl 12 sufficient to convey all solids out of the bowl 12. When the stored electrical energy builds up, the SLC 60 will deactivate the motor 24 causing the bowl to coast and thus discontinue the regeneration of electrical energy as described; and when the stored energy is depleted, the SLC will activate the motor 24 causing a regeneration of electrical energy and a transfer of same to the motor 34 via the drive unit 50 and the bus 54 as described above. This cycling will continue until the bowl comes to a complete stop.

If, due to this power regeneration, there is danger of exceeding the amount of power that the DC bus 54 can handle, the SLC 60 will turn on the drive motor 24 through the drive unit 50 with an acceleration ramp to consume the generated power and maintain the power applied to the DC bus 54 within acceptable limits. Otherwise the operation is the same as set forth above in connection with the previous embodiment.

It is understood that the system of the present invention can include other components, such as torque limit switches, vibration detectors, accelerometers, which are not shown and described herein in the interest of brevity but are disclosed in detail in the above-identified patent application. It is also understood that since all of the above-described connections to and from the SLC 60 are conventional electrical connections involving conventional electrical conductors and the like, they will not be described in any further detail. Further, it is understood that the SLC includes a computer and programmable software to enable it to control the functions described above. Still further, it is understood that the term "electrical energy" as used herein includes electrical current, voltage and pulses.

Several variations can be made in the foregoing without departing from the scope of the invention. For example, the system and method of the present invention can be used in any environment where the variable frequency drive is powering a device which has high rotational inertia. Also, it is understood that the present invention is not limited to processing the slurry described above in connection with an oil field drilling operation. For example, it is equally applicable to the treatment of pulp, paper, waste water, mining separation, and food processing.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

what is claimed is:

1. A method for controlling a centrifuge system having a bowl, a conveyor disposed in the bowl, a first electric motor for rotating the bowl, a second electric motor for rotating the conveyor at a different speed than the bowl, and a source of electrical power for the motors, the method comprising the steps of storing electrical energy, responding to a reduction in the power supplied from the power source to the motors and supplying the stored electrical energy to the second motor to rotate the conveyor and maintain a speed differential between the conveyor and the rotating bowl, braking the bowl in response to the power reduction to permit the first electrical motor to generate electrical energy, and storing the generated electrical energy for use in the step of supplying.

2. The method of claim 1 wherein the electrical energy supplied to the second motor is sufficient to maintain the differential rotational speed between the bowl and the conveyor despite the tendency of the conveyor to attain the same speed as the bowl due to a coupling between the bowl and the conveyor caused by the material being centrifuged.

3. The method of claim 1 further comprising the steps of discontinuing the step of braking when the stored electrical energy increases to a certain value and then resuming the step of braking when the stored electrical energy decreases to a certain value.

4. A method for controlling a centrifuge system having a bowl, a conveyor disposed in the bowl, an electric motor for rotating the bowl and the conveyor at different speeds, and a source of electrical power for the motor, the method comprising the steps of storing electrical energy, responding to a reduction in the power supplied from the power source to the motor and supplying the stored electrical energy to the motor to rotate the conveyor and maintain a speed differential between the conveyor and the rotating bowl, braking the bowl in response to the power reduction to permit the motor to generate electrical energy, and storing the generated electrical energy for use in the step of supplying.

5. The method of claim 4 wherein the electrical energy supplied to the motor is sufficient to maintain the differential rotational speed between the bowl and the conveyor despite the tendency of the conveyor to attain the same speed as the bowl due to a coupling between the bowl and the conveyor caused by the material being centrifuged.

6. The method of claim 4 further comprising the steps of discontinuing the step of braking when the stored electrical energy increases to a certain value and then resuming the step of braking when the stored electrical energy decreases to a certain value.

* * * * *